US005772615A

United States Patent [19]

Elder et al.

[11] Patent Number: 5,772,615

[45] Date of Patent: Jun. 30, 1998

[54] MOTORIZED FOOT MASSAGING DEVICE

[76] Inventors: Bill M. Elder, 130 Woodside Dr., San Anselmo, Calif. 94960; Kenneth Tarlow, 94 Birch Ave., Corte Madera, Calif. 94925

[21] Appl. No.: 717,721

[22] Filed: Sep. 23, 1996

[51] Int. Cl.[6] ..... A61H 15/00

[52] U.S. Cl. ..... 601/126; 601/122; 601/104; 601/102; 601/101; 601/70; 601/69

[58] Field of Search ..... 601/27, 28, 29, 601/30, 32, 46, 49, 67, 69, 70, 97, 98, 100, 101, 102, 103, 104, 126, 122

[56] References Cited

U.S. PATENT DOCUMENTS

| | | | |
|---|---|---|---|
| 2,153,230 | 4/1939 | Bagnell | 601/104 |
| 2,944,543 | 7/1960 | Newcombe | 601/122 |
| 4,011,862 | 3/1977 | Kosiak | 601/115 |
| 4,154,232 | 5/1979 | Fukazawa | 601/122 |

FOREIGN PATENT DOCUMENTS

| | | | |
|---|---|---|---|
| 405042186 | 2/1993 | Japan | 601/126 |
| 2246298 | 9/1996 | United Kingdom | 601/119 |

*Primary Examiner*—Robert A. Hafer
*Assistant Examiner*—Benjamin K. Koo

[57] ABSTRACT

An improved motorized foot massager having three pairs of massaging modules. Each pair of massaging modules is comprised of a centrally located motor and gear reduction assembly and a left and right set of massaging cams. Each cam set is comprised of a plurality of horizontally disposed shafts, each shaft having a plurality of off set cams. The front pair of massaging modules is intended for the toes and ball of the foot. The middle section is intended for the arch area and the Rear section is intended for the heal portion of the foot. The front and rear section are slidable and lockable so that the unit can be adjusted to a particular persons foot. A cloth housing covers the rotating cams to prevent a users toes from being pinched by the rotating cams. The center, arch massaging modules are able to be raised or lowered to accommodate for an individuals arch height. A heal guide attached to the rear massage modules helps a person place his or her foot in the proper location. An additional motor with off center weight mounted to its shaft is mounted to the main base which caused the entire unit to vibrate if so desired.

6 Claims, 8 Drawing Sheets

CHART OF IMPORTANT REFLEX POINTS

RIGHT FOOT

MOTORIZED FOOT MASSAGING DEVICE

BACKGROUND OF THE INVENTION

The present invention relates to portable massaging devices and more specifically to a motorized portable massaging device directed toward the massaging of a persons feet.

Various types of motorized foot massaging devices are known. The most common type is made using a motor with an off center weight mounted to the shaft. The motor is mounted to resilient rubber pads. which in turn mount to a base. The upper portion of the motor is attached to a foot plate which is made to vibrate by the oscillating action of the spinning motor shaft and attached off center weight. The vibration causes a general increase of blood circulation in the area of the foot being vibrated but does not effectively break up crystalline structures that build up in the foot as a result of stresses and strains of daily life. Another type of foot massager employees a motor and gear reduction system which drives a pair of slowly oscillating finger members which attempt to duplicate a masseurs fingers giving a deep tissue massage. This type of foot massager can break up the build-up of crystal structures in the foot, however, the user has to constantly move his or her foot to the oscillating finger members and the user can not be sure that the proper reflexology release points are being massaged. Moreover, the user does not have a choice of the height of the massaging fingers so that the user with sensitive feet must be careful to not put the full weight of ones leg over the oscillating massage finger.

An entire science has evolved concerning the relief of stress in various parts of the human body by vigorous stimulation of specific areas located on the sole of the foot. This science is called reflexology and is practiced by many specialists around the world. For example, the area of the big toe is associated with relieving sinus problems. The area at the ball of the foot is associated with stomach disorders. Each specific area of the sole of the foot is connected to a different organ of the body according to those who practice reflexology. The current motorized foot massagers on the market today do not let the user customize the location of the massaging points to correspond to the users particular foot size and shape. Therefore these units will never adequately give a deep tissue massage to all the specific reflexology points of the sole of a users foot or feet while the users foot remains essentially stationary.

OBJECT AND SUMMERY OF THE PRESENT INVENTION

It is an object of the present invention to provide an improved motorized foot massaging device wherein multiple slowly rotating massaging cams can be positioned by the user so that the cams can stimulate the correct areas of the users foot regardless of the users foot size and shape. Another object of the present invention is to provide an improved motorized foot massaging device wherein there are a number of slowly rotating cams to effectively massage the entire foot or feet simultaneously without the need for the user to move his or her feet. It is a further object of the present invention to provide an improved motorized foot massaging device wherein the user can select to use or not use various sections of the massaging device to at any one time. Another object of the present invention is to provide an improved motorized foot massaging device wherein a vibrating foot plate can be activated along with the slowly rotating massaging cams. A further object of the present invention is to provide an improved motorized foot massaging device wherein the users foot can be positioned by means of a heal and to guide so that the foot remains in the optimal location for massaging points on the sole of the foot. It is a further object of the present invention to provide an improved motorized foot massaging device wherein the height of the massaging cams can be adjusted to allow the user to have a deep massage or a less deep massage. A further object of the present invention is to provide an improved motorized foot massaging device wherein the user can secure additional layers of padded material to the top surface thereby reducing the impinging effect of the rotating cams on the users foot.

The above objects are accomplished by providing three sets of multiple rotating cams for each foot which can be slid forward and rearward to adjust to the users foot size. The central set of rotating cams can be raised or lowered to adjust for the users arch height. Each set of rotating cams is powered independently so that a user can elect to use one, two or all three sets of cams at any one time. An additional built in motor with off center weight attached to the its shaft can be activated by the user to give an additional vibrational massaging effect and increase blood circulation to the foot. A cloth cover encloses all the cam sets so that the users toes will not accidentally be pinched by the multiple rotating cams. An additional padded cover may be attached to the top of the cloth cover to further minimize the massaging effect of the rotating cams for those with more sensitive feet.

These and other objects of the present invention will be fully described in the drawings and description of drawings shown below. Although the following description shows a preferred embodiment of the present invention, it is to be understood that there may be other closely related means for performing many of the stated functions which will be known by those versed in the art of motorized foot massagers and which will be covered by the spirit of this patent.

DETAILED DESCRIPTION OF THE DRAWINGS

Figure 1:
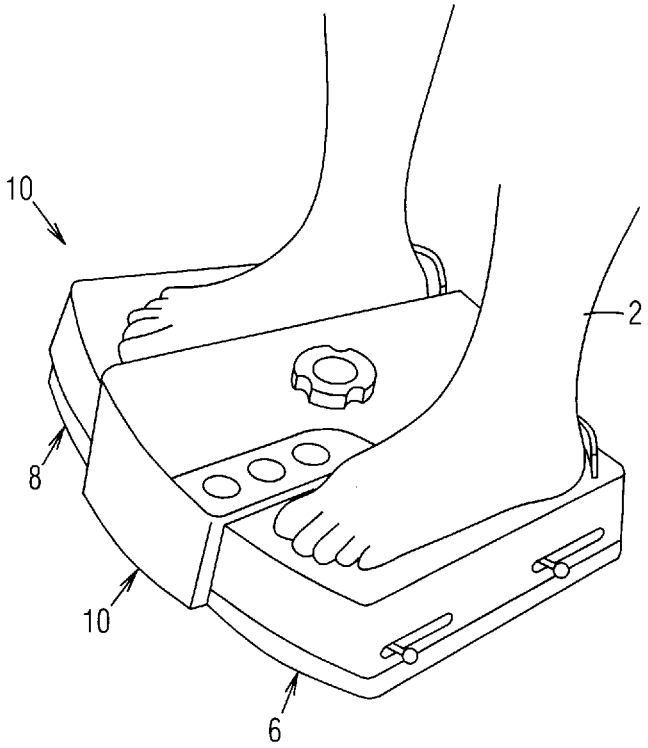
FIG. 1 is a perspective view of the present invention showing a persons feet in place on the invention.
Figure 2:
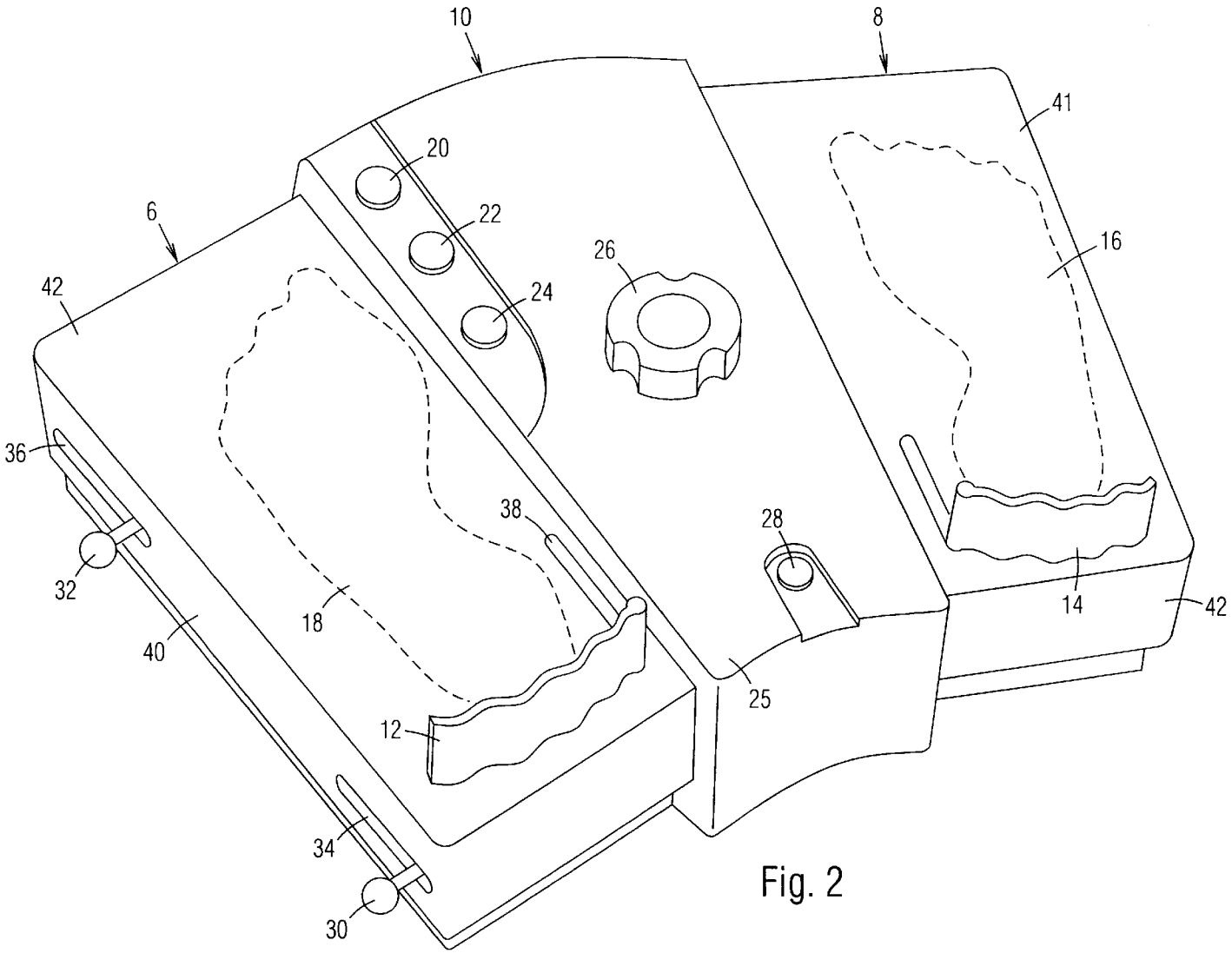
FIG. 2 is a more detailed perspective view of the present invention

Referring now to FIG. 1 a persons feet 2 are resting compfortably on the foot massaging device 4 of the present invention. The person is preferrably in a sitting position. The device is made up of three main sections, a right foot platform 6 a left foot platform 8 and a central section 10. FIG. 2 shows the device in more detail. Right foot platform 8 and left foot platform 6 have thin, soft cloth covers 41, 42 and are slightly angled apart from one another so that the heels of the users feet are closer together than the toes of the users feet thereby more closely dupicating the normal resting position of a persons feet while in the sitting position. Dotted lines 16, 18 indicate where the users feet go. The central section 10 is covered by a hard shell made of either plastic or metal. Control switches 20, 22, 24, 28 are located on top of central cover 25 and are large and of a push on-push off type which can be operated by the users toe. Switch 20 activates the front massaging modules. Switch 22 activates the middle massaging modules and switch 28 activates the rear massaging modules. The user may activate any or all of the massaging modules at any one time. Switch 28 activates a vibration mode which causes the entire unit to vibrate. Knob 26 controls the height of the middle massage modules as will be shown in FIG. 3. Heel rests 12, 14 indicate where the user is to place his or her feet. Slide knobs can be loosened and slid forward or backward to adjust the heel and toe massage modules to accommodate a particular users foot as is shown in more detail in FIG. 3.

Figure 3:
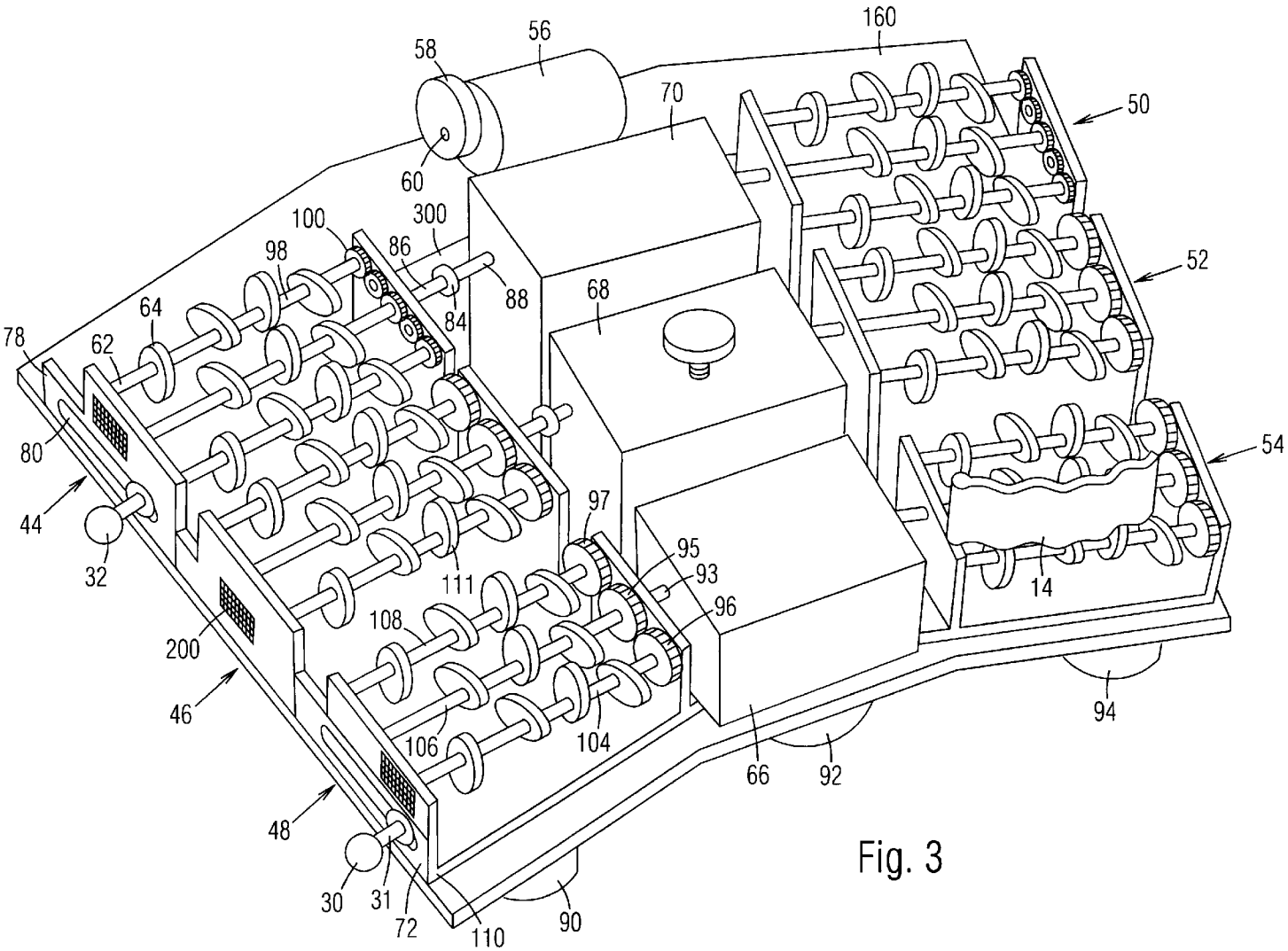
FIG. 3 is perspective view of the present invention with the cloth foot covers removed.
Figure 8:
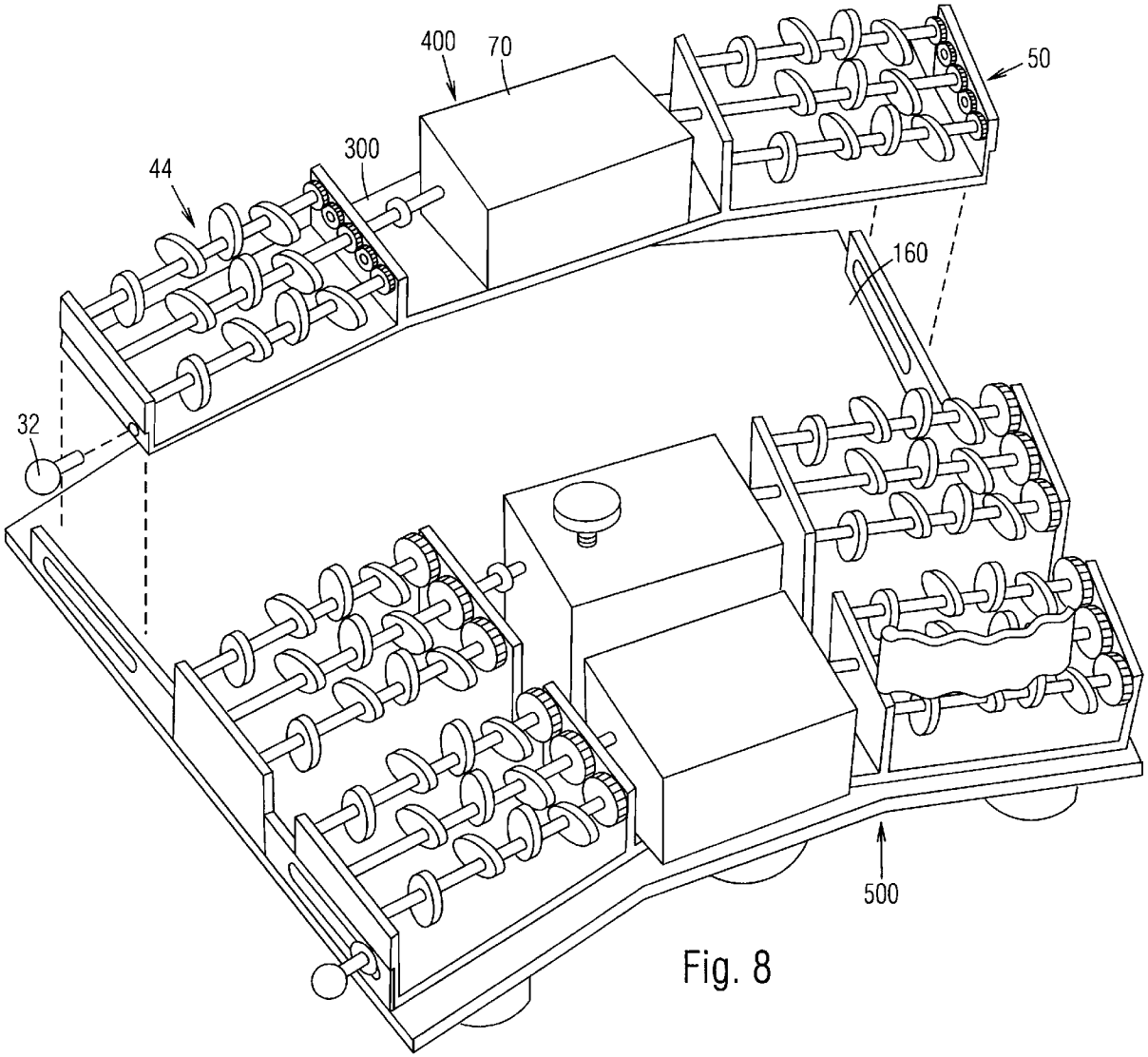
FIG. 8 is an exploded view of the front set of massage modules which is ready to be placed onto the rest of the unit.

FIG. 3 shows the foot massager of the present invention with the cloth covers removed. Six blocks 44, 46, 48, 50, 52, 54 of massaging cams can be seen. Blocks 44 and 50 are driven by motor and gear assembly 70. Blocks 46 and 52 are driven by motor and gear assembly 68. Blocks 48 and 54 are driven by motor and gear assembly 66. The toe section is composed of cam modules 44 and 50 and motor drive 70 are mounted on a common carrier 300 and can be slid forward or backward depending on the users foot size. Knob 32 slides in slot 80 and can be screwed clockwise to lock the entire toe assembly in position. The arch section is composed of massage modules 46 and 52 and motor assembly 68 and is in a fixed position. The heel section is composed of massage modules 48 and 54 and motor assembly 66 and is able to slide forward and backward to accommodate the users exact foot size. Knob 30 slides in slot 72. The entire heel assembly is locked in place when knob 30 is turned in a counter clockwise position thereby causing treaded shaft 31 to screw into side wall 110 which in turn clamps the shoulder washer on knob 30 to the side wall 72. FIG. 8 shows one complete toe section 400 which more clearly shows how the entire section is joined by a common base plate 300. Heel section 500 is set up in a similar way.

Referring back to FIG. 3, each massaging module has velcro hook type fastener 200 attached to its outer most side and a mating loop type fastener is sewn into the inside of the cloth cover 42 thereby removably holding the cloth cover in place. The cloth cover allows a user to experience the benefit of the massaging cams 64 without the possibility of accidentally pinching a part of the foot such as a toe. Each massage module has three shafts. 98 containing a plurality of cam shaped massage cams 64. The massage cams 64 are positioned along the shaft 62 in such a way that each cam is set ninety degrees from the next. In this way the cams can stimulate each portion of the sole more completely. In the heel and arch modules a spur gear 95 attached to drive shaft 93 drives the center shaft 106 and spur gears 96, 97, to either side of the center gear 95 drive the two shafts 104, 108 at either side of the central shaft 106.In the toe module the same format is basically true except that there are intermediary gears 100 which cause all the shafts 62 and associated massage cams 64 to turn in the same counter clockwise direction thereby massaging the users toes in such a way as to not allow a pinching action which could occur if the cams 64 rotated in a clockwise direction. Flex coupling 64 is found connecting the main drive shaft 86 of each massage module to the motor and gear reduction drive shaft 88. This allows for the five degree change in angle between the two shafts 88 and 86. Motor 56 located at the front of the entire assembly and attached to base plate 160 spins off set weight 58 which causes a vibrating sensation which is transmitted to all the massage modules. The user then has the option of using the vibrator which tends to increase blood circulation. A plurality of large resilient rubber feet separate the main base plate 160 from the floor which isolates and enhances the vibration caused by motor 56 and weight 58 to the massage modules.

Figure 4:
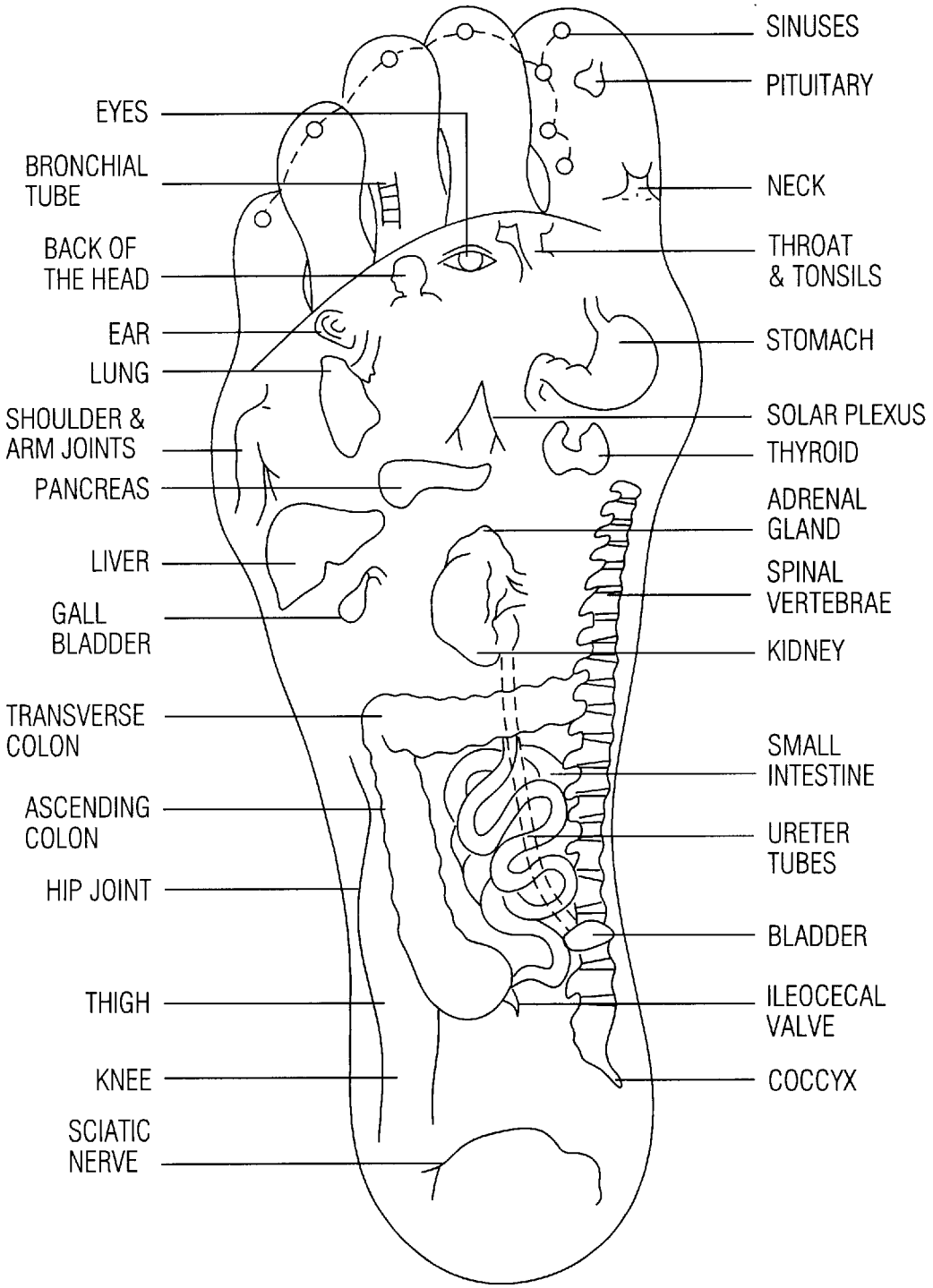
FIG. 4 is a reflexology chart

Referring now to FIG. 4 Which is a reflexology chart showing the sole of a persons right foot; you can see that the science of reflexology teaches that each portion of a persons foot corresponds to a different part of a persons anatomy. For example, the heel of the foot relates to the sciatic nerve and the center of the big toe relates to the pituitary gland and so forth. The present invention is designed to allow a user to simultaneously massage all areas of the sole of both feet in such a way that all the reflexology points are enlivened thereby causing energy to flow to all corresponding anatomical parts shown in FIG. 4.

Figure 5:
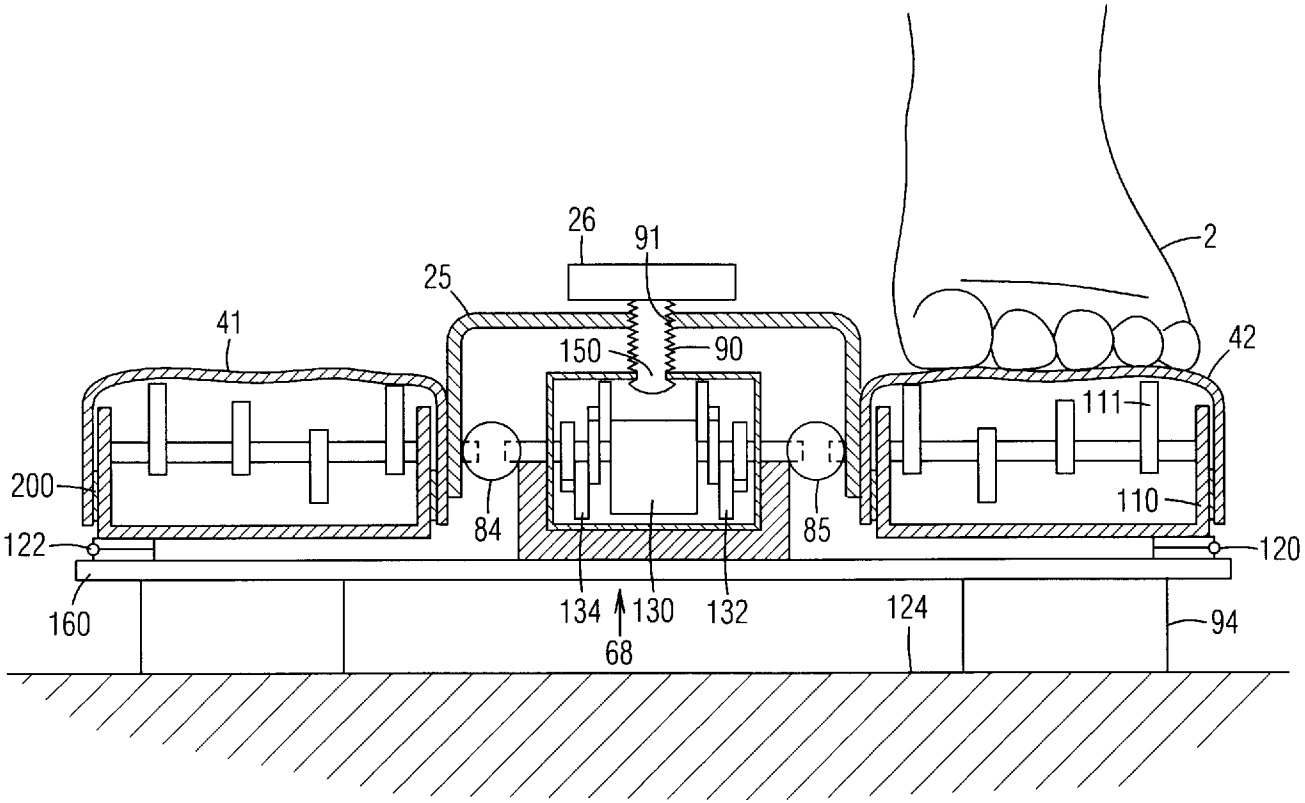
FIG. 5 is a section view if the present invention showing the central massage sections in a lowered position.
Figure 6:
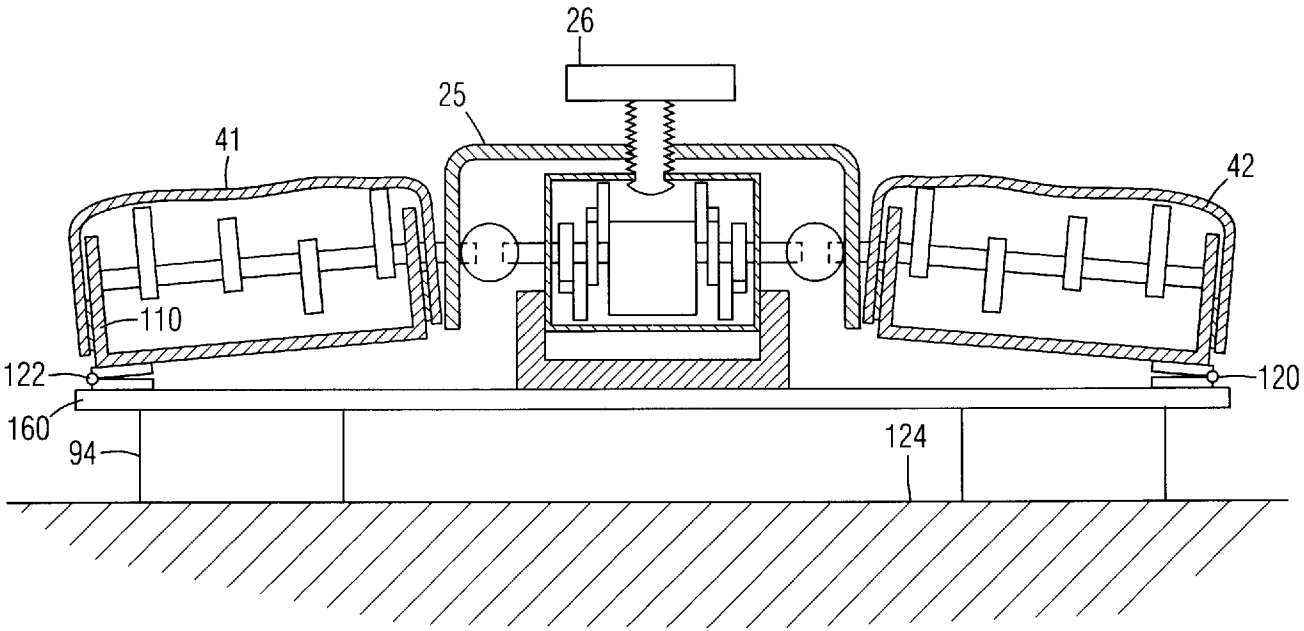
FIG. 6 is a section view of the present invention showing the central massage sections in a raised position.

FIG. 5 shows a section view of the arch portion of the massage unit of the present invention. In this view, the motor 130 and associated gear reduction trains 132, 134 are clearly shown. Motor 130 has a shaft protruding from each side to drive the gear trains 132 and 134. The final drive speed coming from the gear reduction train is approximately 30 revolutions per minute. In order to accommodate the variation in arch height from one user to another, the massage modules 41 and 42 are hinged at points 120 and 122 so that the inboard portion of both massage modules can be raised or lowered by turning knob 26 which causes motor assembly 68 to be raised or lowered when threaded shaft 90 interacts with treaded hole 91 in motor housing 25. FIG. 6 shows massage modules 41 and 42 in the raised mode for a user who has high arches.

Figure 7:
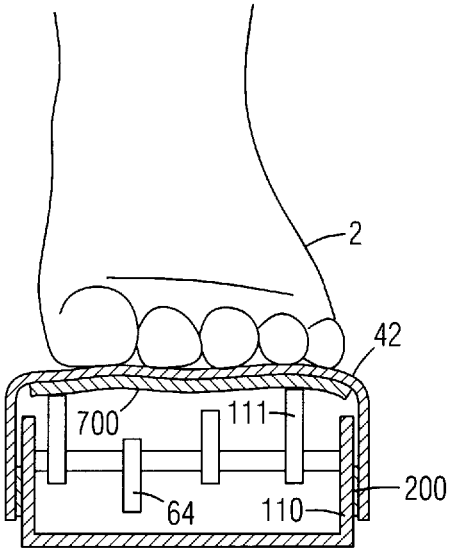
FIG. 7 is a section view of one cam module of the present invention where an intermediate padded panel is in place for sensitive feet.FIG.

FIG. 7 shows a section view of a massage module where an additional padded cloth 700 has been added under main cloth cover 42 so that a user with sensitive feet can experience the massaging effect with less discomfort.

While the invention has been described in connection what are presently considered to be the most practical and preferred embodiment, it is to be understood that the invention is not limited to the disclosed embodiment, but, on the contrary, it is intended to cover various modifications and equivalent arrangements included within the spirit and scope of the appended claims.

We claim:

1. An improved motorized foot massaging device, comprising:

a front pair, a center pair, and a rear pair of massaging modules mounted to a rigid base plate;

a plurality of resilient rubber pads attached to an underside of said base plate;

each of said pairs of massaging modules being comprised of a rigid sub-plate to which a centrally located motor is attached, said motor having a pair of drive shafts protruding from opposite sides thereof, and a gear reduction system coupled to each of said drive shafts which are connected via flexible joints to said massaging modules;

each of said massaging modules being comprised of a U-shaped frame supporting a plurality of horizontally disposed shafts, each of said shafts having a spur gear so that the spur gear of one shaft meshes with and drives the spur gear of an adjoining shaft thereby causing all shafts to rotate, said shafts having a plurality of permanently fixed cams radiating at ninety degrees therefrom, each of said cams being offset by ninety degrees from an adjacent one of said cams, said front pair and said rear pair of said massaging modules being slidable and lockable onto said base plate, all of said massaging modules being covered by removably affixed cloth covers, all of said motors and said gear reduction systems being covered by a rigid housing.

2. The improved motorized foot massaging device of claim 1, wherein an outermost edge of a left module and an outermost edge of a right module of said center pair are hinged to said base, and a rotatable threaded shaft is attached perpendicularly to said centrally located motor, said threaded shaft protruding through a mating fixed nut portion located in said rigid housing, the turning of said rotatable threaded shaft controlling the raising and lowering of said motor and said left module and said right module.

3. The improved motorized foot massaging device of claim 1, wherein an additional motor with an off center weight attached to a shaft thereof is permanently affixed to said base plate.

4. The improved motorized foot massaging device of claim 1, wherein any one of said pairs of said massaging modules can be activated independently.

5. The improved motorized foot massaging device of claim 1, wherein a heel guide is affixed perpendicularly on top of said rear pair of said massaging modules, thereby allowing a user to locate a foot properly in relation to said massaging modules.

6. The improved motorized foot massaging device of claim 1, wherein an additional layer of padded material is attached to said cloth cover so that a resulting massaging action of said cams is minimized for people with sensitive feet.

* * * * *